United States Patent [19]

Duvdevani et al.

[11] Patent Number: 4,634,542

[45] Date of Patent: Jan. 6, 1987

[54] NOVEL INTERPOLYMER COMPLEXES OF SULFONATED OCTENE-1 COPOLYMER

[75] Inventors: Ilan Duvdevani, Leonia; Joseph Wagensommer, Westfield; Pawan K. Agarwal, Bridgewater, all of N.J.

[73] Assignee: Exxon Research and Engineering Company, Florham Park, N.J.

[21] Appl. No.: 801,948

[22] Filed: Nov. 26, 1985

[51] Int. Cl.[4] ..... C10M 107/10; C10M 107/12; C10M 107/46

[52] U.S. Cl. ..... 252/47.5; 252/33; 252/47; 252/46.4

[58] Field of Search ..... 252/47, 47.5, 33

[56] References Cited

U.S. PATENT DOCUMENTS

| | | | |
|---|---|---|---|
| 3,396,136 | 8/1968 | Dickerson | 252/33 |
| 3,666,430 | 5/1972 | Osmond et al. | 149/108.8 |
| 3,679,382 | 7/1972 | Cohrs et al. | 149/108.8 |
| 3,931,021 | 1/1976 | Lundberg | 252/33 |
| 4,144,181 | 3/1979 | Elliot et al. | 252/47.5 |

*Primary Examiner*—William R. Dixon, Jr.
*Assistant Examiner*—Ellen M. McAvoy
*Attorney, Agent, or Firm*—Richard E. Nanfeldt

[57] ABSTRACT

A method for controlling the viscosity of organic liquids, said organic liquid having a solubility parameter of from about 6 to about 10.5, which comprises incorporating in said organic liquid a minor amount of a polymer complex, said complex being comprised of a sulfonated copolymer of octene-1/ENB or a sulfonated copolymer of hexene-1/ENB or a sulfonated terpolymer of hexene-1/ethylene/ENB or a sulfonated terpolymer of octene-1/ethylene/ENB and polymer B, containing basic nitrogen groups, both functional groups being present at a level of from about 4 to 500 meq. per 100 g. of polymer, wherein polymer B has the formula:

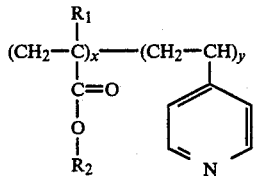

or

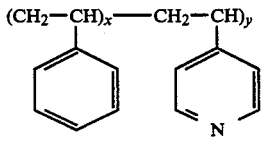

wherein $R_1$ is H or an alkyl group having about 1 to about 8 carbon atoms, $R_2$ is an alkyl group having about 1 to about 18 carbon atoms, x is about 50.0 to 99.8 mole percent and y is about 0.2 to about 50.0 mole percent.

18 Claims, No Drawings

NOVEL INTERPOLYMER COMPLEXES OF SULFONATED OCTENE-1 COPOLYMER

FIELD OF THE INVENTION

The instant invention relates to a process for controlling the viscosity of organic liquids by incorporating in said liquid a minor amount of two interacting polymers and optionally, a cosolvent for the ionic groups of said polymer. The ionic polymer comprises a backbone which is substantially soluble in said organic liquid, and pendant ionic groups which are substantially insoluble in said organic liquid. The other polymer contains basic nitrogen atoms such as amine groups which interact with the ionic counterion and form a complex. A cosolvent is optionally added which will optionally solubilize the pendant ionomeric groups and provide a reasonably homogeneous mixture of solvent, cosolvent and ionomeric polymer. The preferred compositions prepared by the method of the instant invention comprise an organic liquid having a solubility parameter of from 6 to 10.5 in combination with a sulfonated co- or terpolymer containing from 0.2 up to 10.0 mole % ionic groups which has been neutralized by a basic material selected primarily from the group consisting of transition elements (Groups VIIIA, IB and IIB), and also groups IA and IIA, and lead, tin, aluminum and antimony of the Periodic Table of the Elements, wherein the sulfonated co- or terpolymer is complexed with a polymer containing basic nitrogen atoms such as an amine-containing polymer and optionally, a nonvolatile alcohol or amine as the cosolvent.

BACKGROUND OF THE PRIOR ART

The rapid decrease in viscosity of liquids with increasing temperature on polymer concentration is well-known. Ideally, for many applications (automobile lubricants, etc.) it would be desirable to solve this problem so that viscosity would be insensitive to temperature or polymer level. Alternatively, it might be desirable to provide liquid systems whose viscosities actually increase with temperature or increase as polymer level is decreased. It is true that with selected polymeric additives, it has been possible to reduce substantially the viscosity change with temperature which does occur with most oils and similar systems. These polymer additives, known as viscosity index improvers (or V.I. Improvers) are generally high molecular weight polymers.

The way in which these additives function can be summarized very briefly. In effect, they perform two functions, i.e., thickening, which merely increases fluid viscosity; and Viscosity Index (V.I.) improvement, which corresponds to limited thickening at ambient temperatures and a correspondingly greater thickening at elevated temperatures. This can be accomplished by utilizing a polymeric additive which is poorly solvated by the liquid at ambient temperatures; however, at elevated temperatures the polymer is more highly solvated such that the polymer expands and is a relatively more effective thickener.

While these V.I. Improvers have proven successful commercially, it is important to note that their effect at reducing viscosity changes with temperatures is rather mild. For a typical base oil containing a suitable V.I. Improver, the kinematic viscosity will still decrease by a factor of from 5 to 10 as the temperature increases from 30° to 100° C. Obviously, if it is desired to hold the viscosity roughly constant with such temperature changes, current technology has not offered an appropriate additive system. Alternatively, if it is desired to hold viscosity reasonably constant as the polymer concentration is decreased, conventional wisdom has not previously offered that option.

The polymer complexes of the instant invention are effective antimisting agents for gasoline and jet fuels.

U.S. Pat. No. 3,396,136 describes how copolymers of alkenyl aromatic sulfonic acids, when properly neutralized, can be employed as thickeners for nonpolar solvents. Those metal sulfonate systems have been shown to be very effective; however, when employed as two component systems (i.e., ionic polymer plus nonpolar solvent), the variation of viscosity with increased temperature is very conventional and predictable. That is, the solution viscosity decreases markedly as temperature is increased.

U.S. Pat. No. 3,396,136 further teaches "in situ" neutralization of the sulfonic acid polymer which, under some conditions, can result in the availability of a small amount of polar cosolvent—i.e., a solvent for the sulfonate groups about equal in amount to the amount of sulfonate groups which are present. This amount of polar cosolvent is not within the limits of the instant invention, which only optionally requires amounts of the third component (which interacts with the ionomeric groups of the ionomer copolymer) at levels which range from 10 to 600 times the molar equivalence of ionic groups. This level of cosolvent is about one to two orders of magnitude or more higher than employed in the cited art. In addition, the cited patent is restricted to aromatic sulfonate polymers. The instant invention describes other polymers such as sulfonated co- and terpolymers of hexene-1/ethylene/ENB and octene-1/ethylene/ENB, which are a portion of the polymer complex.

U.S. Pat. No. 3,666,430 teaches the gelling of organic liquids by the interaction of polar "associative bonds" which includes hydrogen bonding and "ionic cross-linking". Again, this patent specifies that two components are necessary—the associating polymer (or polymers in some cases) and the nonpolar organic liquid. There is no mention of a third polar cosolvent except to point out that such polar liquids should not be present. Specifically, this patent states (Column 2, line 7) that the hydrocarbon liquids to which this invention is to be applied should not contain a substantial portion of a miscible protolytic liquid such as methanol. It is clear that the language of this patent limits this invention to gels and further, that any amount of polar liquids which are present to an extent where they disrupt those gels are undesirable. The instant invention is distinct from that cited in that amounts of such polar compounds, as will break up gel at ambient conditions, are often desirable and, in fact the preferred state is free of any said gel at ambient temperatures.

U.S. Pat. No. 3,679,382 teaches the thickening of aliphatic hydrocarbons with synthetic organic polymers which contain olefinically unsaturated copolymerizable acids, amides, hydroxyacrylic esters, sulfonic acids, etc. It is emphasized in this patent (Column 3, line 72) that it is critical that in the preparation of such polymers, no surface active agent, catalyst or other additive be employed which introduces a metallic ion into the system. Therefore, it is preferred to employ ammonium or amine salts. It is clear that this invention (U.S. Pat. No. 3,679,382) specifically precludes the use of metallic counterions—and is directed towards amine or ammonium derivatives. Metallic counterions are very effective in the instant invention. Finally, this cited patent does describe (Column 7, lines 13–19) that the addition of alcohols will reduce the viscosity of the thickened hydrocarbon and alter flow characteristics thereof.

U.S. Pat. Nos. 3,931,021 and 4,118,361 describe the use of ionic polymers and required cosolvents in an organic liquid and V.I. Improvers. The instant invention represents an improvement over U.S. Pat. Nos. 3,931,021 and 4,118,361, and therefore provides a new dimension in viscosity control of hydrocarbon-based solvents. Specifically, it has been discovered that these complexes offer a "flatter" viscosity-temperature relationship than do the sulfonate ionomers previously disclosed. Furthermore, the types of ionic polymers previously described as viscosifiers for oils and low polarity diluents usually are effective thickeners at modest levels, but if one attempts to make a concentrate (10% polymer by weight) the resulting solution is too viscous to handle. The solutions described in this invention can have relatively low viscosities at high concentrations of polymer, yet maintain relatively high viscosities at low polymer concentrations. This change in the viscosity-concentration relationship is a fundamental discovery of potentially great practical relevance. We have indeed observed that this invention is capable of polymer solutions which can be further diluted over broad polymer concentration ranges without a concurrent decrease in solution viscosity—and, in fact, viscosity can actually increase under conditions described herein and gelation can occur.

SUMMARY OF THE INVENTION

It has been discovered that the viscosity of organic liquids may be conveniently controlled by incorporating in said organic liquid a minor amount of a polymer complex which is the reaction product of a sulfonated co- and terpolymer and a polymer containing low levels of nitrogen atoms. The polymer complex is characterized as having polymer backbones which are substantially soluble in the organic liquid, and pendant sulfonate groups which are substantially insoluble in the organic liquid.

The number of sulfonate groups contained in the sulfonated co- or terpolymer of the polymer complex is a critical parameter affecting this invention. The number of sulfonate groups present in the co- or terpolymer can be described in a variety of ways such as weight percent, mole percent, number per polymer chain, etc. For most polymer systems of interest in this invention, it is desirable to employ mole percent. For vinyl homopolymers, such as polystyrene, the sulfonated analog having a sulfonate content of 1.0 mole percent means on the average that one out of every 100 monomer repeat units in the polymer chain is sulfonated. In the case of copolymers, the same definition applied, except for the purposes of this calculation, the polymer can be considered to be prepared from a hypothetical monomer having an average molecular weight, which is the average of the two monomer components. Similarly for terpolymers, the same averaging concepts apply; however, three components are involved. For example, hexene-1—ethylidene norbornene (ENB) is a preferred copolymer backbone for this invention. A representative terpolymer would have a composition (weight percent) of 80% hexene-1, 17% ethylene and 3% ENB. This composition has an average repeat unit molecular weight of about 63.1. Thus, sulfonation of this composition, which occurs at the unsaturation of the ENB units to a level of 1.0 mole %, which means that in 63.1 g. (1 mole of average monomer repeat units) of this polymer, there would be present 0.01 mole of sulfonic acid groups. An alternate way of expressing this is to state the sulfonate level in terms of milliequivalents of sulfonic acid groups per 100 gms of polymer or meq. per 100 g. of polymer. This latter procedure provides a rapid and independent measure of sulfonic acid content in a polymer through simple titration. In the above example, 1.0 mole % of sulfonation would be about 15.8 meq. per 100 g.

Both mole percent sulfonate and milliequivalent of sulfonate will be employed to describe the sulfonate polymers employed in this invention.

In general, the sulfonated co- or terpolymer will comprise from about 1 meq. up to 40 meq. of sulfonate groups per 100 g. of polymer, more preferably about 1 meq. to about 30 meq. of pendant sulfonate groups per 100 g. of polymer. The sulfonated copolymers or terpolymers of the instant invention are sulfonated terpolymers of hexene-1/ethylene/ENB and sulfonated terpolymers of octene-1/ethylene/ENB and sulfonated copolymers of hexene-1/ENB and octene-1/ENB.

The terpolymers of the instant invention are formed by the process according to the steps of forming a mixture of an alkane solvent, hexene-1 or octene-1 monomer, ethylene monomer, ENB monomer and diethyl aluminum chloride; reacting the mixture from 0° C. to 60° C.; adding a solution of a modified $TiCl_3$ based catalyst in an alkane to said mixture and stirring for a sufficient period of time to cause co-or terpolymerization; terminating the reaction with isopropanol and precipitating the polymer from the reaction solution. The copolymers of the instant invention are formed by the same process except that the ethylene monomer is not present.

The sulfonated co- and terpolymers of the instant invenion may vary in number average molecular weight as measured by GPC from 20,000 to 10,000,000, preferably 50,000 to 8,000,000, most preferably from 100,000 to 8,000,000.

Neutralization of the formed sulfonated co-or terpolymers with appropriate metal hydroxides, metal acetates, metal oxides, etc. can be conducted by means well-known in the art. For example, the sulfonation process as with Butyl rubber containing a small 0.3 to 1.0 moles% unsaturation, can be conducted in a suitable solvent such as toluene with acetyl sulfate as the sulfonating agent. The resulting sulfonic acid derivative can then be neutralized with a number of different neutralization agents such as sodium phenolate and similar metal salts. The amounts of such neutralization agents employed will normally be stoichiometrically equal to the amount of free acid in the polymer plus any unreacted reagent which still is present. It is preferred that the amount of neutralization agent be equal to the molar amount of sulfonating agent originally employed plus 10% more to ensure full neutralization. The use of more of such neutralization agent is not critical. Sufficient neutralization agent is necessary to effect at least 50% neutralization of the sulfonic acid groups present in the polymer, preferably at least 90%, and most preferably essentially complete neutralization of such acid groups should be effected. The degree of neutralization of said ionomeric groups may vary from 50 to 500 mole %, preferably 90 to 200%. Most preferably, it is preferred that the degree of neutralization be substantially complete, that is, with no substantial free acid present and without substantial excess of the base other than that needed to ensure neutralization. Thus, it is clear that the polymers which are utilized in the instant invention comprise substantially neutralized pendant groups and, in fact, an excess of the neutralizing material may be utilized without defeating the objects of the instant invention.

We have surprisingly found that a very important factor in determining the strength of the interaction between the amine-containing polymer and the sulfonate-containing co- or terpolymer is the nature of counterion. There are, broadly speaking, three major classes of such counterions. The first class, which are less preferred, are those elements of Group IA and Group IIA, which include Li, Na, K, etc., Be, Mg, Ca, etc. We have found that these species do not interact as strongly with amine groups as the more preferred species described below. Those elements are commonly defined as members of the transition elements (see chemical text: "Chemical Principles and Properties", by M. J. Sienko and R. A. Plane, McGraw Hill Book Co., 1974, page 19). Such cations are best exemplified by zinc and interact strongly with pyridine and similar amines. As a consequence, a zinc neutralized sulfonated polymer interacts much more strongly with a styrene/vinyl pyridine copolymer than does a magnesium or sodium neutralized system. It is for this reason that the transition elements are preferred with zinc copper, iron, nickel and cobalt being especially preferred. We also include antimony and lead as suitable cations.

A third species which is preferred is the free acid of the sulfonated polymer, which will also interact with amine-containing polymers. In this latter case, it is clear that the interaction is a classic acid-base interaction, while with the transition metals, a true coordination complex is created, which is due to the donation of the electron pair of the nitrogen element. This distinction is a very important one and sets these complexes apart from classic acid-base interactions. The surprising observation is that such coordination complexes can form in such extreme dilution insofar as interacting groups are concerned, and that they are apparently formed so far removed from their expected stoichiometry, (based on small molecule analogs).

Preferably, the amine content in the basic polymer is expressed in terms of basic nitrogen. In this respect, the nitrogen content in amides and similar nonbasic nitrogen functionality is not part of the interacting species. For example, the amount of vinyl pyridine in the amine-containing polymer can vary widely, but should range from less than 50 weight percent down to at least 0.2 weight percent, more preferably about 0.2 to about 10.0 weight percent in the case of an alkyl methacrylate/vinyl pyridine copolymer or an acrylate/vinyl pyridine copolymer having the formula:

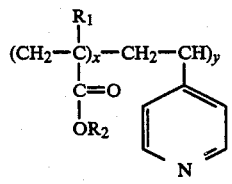

wherein $R_1$ is H or an alkyl group having about 1 to about 8 carbon atoms, $R_2$ is an alkyl group having about 1 to about 18 carbon atoms, x is about 50 to about 99.8 weight percent, more preferably about 95 to about 99.8 weight percent, y is about 0.2 to about 50 mole percent, more preferably about 0.2 to about 10.0 mole percent. Another example is a copolymer of styrene with 4 vinylpyridine.

A minimum of three basic groups must be present on the average per polymer molecule and the basic nitrogen content generally will range from 2 meq. per 100 grams of polymer up to 500 meq. per 100 g. A range of 8 to 200 meq. per 100 g. is preferred.

It is desirable that these organic polymer backbones of the sulfonated co- or terpolymers (in the absence of the sulfonate groups) be soluble in the organic liquid, whose viscosity is to be controlled. To achieve the desired solubility, it is required that the polymer to be employed possess a degree of polarity consistent with that solvent. This solubility relationship can be readily established by anyone skilled in the art simply by appropriate texts (e.g., Polymer Handbook, edited by Brandrup and Immergut, Interscience Publishers, 1967, section IV-341). In the absence of appropriate polymer-solvent compatibility knowledge, this can be determined experimentally by observing whether the selected polymer will be soluble in the solvent at a level of 1 gm polymer per 100 ml solvent. If the polymer is soluble, then this demonstrates that it is an appropriate backbone for modification with sulfonate groups to achieve the objectives of this invention. It is also apparent that polymers which are too polar will not be soluble in the relatively nonpolar organic liquids of this invention. Therefore, only those polymer backbones (i.e., as measured in the absence of ionic groups) having a solubility parameter less than 10.5 are suitable in this invention. This precludes the use of such polymers as polyvinyl alcohol, polyacrylonitrile, etc. Also highly crystalline polymers are to be avoided since they tend not to be soluble in the relatively nonpolar organic liquids employed herein. Therefore, acceptable polymers employed in this invention must possess a level of crystallinity of less than 25%. Thus, these acceptable polymers can be considered substantially noncrystalline.

We have also observed that polymers normally insoluble in non-polar solvents such as mineral oils, that the interaction via complexation can induce solubility if one of the polymers is sufficiently soluble.

The sulfonated co- or terpolymers of the instant invention may be neutralized prior to incorporation into the organic solvent, or by neutralization of the acid form in situ. For example, preferably the acid derivative is neutralized immediately after preparation. For example, if the sulfonation of hexene-1/ENB is conducted in solution, then the neutralization of that acid derivative can be conducted immediately following the sulfonation procedure. The neutralized polymer may then be isolated by means well-known to those skilled in the art; i.e., coagulation, steam stripping, or solvent evaporation, because the neutralized polymer has sufficient thermal stability to be dried for employment at a later time in the process of the instant invention. It is well-known that the unneutralized sulfonic acid derivatives do not possess good thermal stability and the above operations avoid that problem.

The basic nitrogen-containing polymer such as a lauryl methacrylate/vinyl pyridine copolymer or styrene/vinyl pyridine of the polymer complex is usually formed by free radical copolymerization using techniques well-known in the polymer literature. Such polymers can be prepared by a variety of techniques by reacting a basic nitrogen-containing monomer with the alkyl acrylates, or alkyl methacrylates, such as lauryl methacrylate. An emulsion polymerization process is generally preferred, but other processes are also acceptable.

The polymer complex of the sulfonated co- or terpolymer and the basic nitrogen-containing polymer can be formed by forming a first solution of the sulfonated co- or terpolymer in an organic liquid and a second solution of the basic nitrogen-containing polymer in the organic liquid, wherein the organic liquid which has a solubility parameter of less than 9.5 and a viscosity of less than about 35 centipoises and is selected from the group consisting of mineral oil, synthetic oil, lubricating oils, alkanes, cycloalkanes and aromatics and mixtures thereof. Alternately both components of the complex can be simultaneously dissolved in the same solvent systems at the desired concentrations. The concentration of the sulfonated co- or terpolymer in the first solution is about 0.01 to about 10 grams per 100 ml of organic liquid, more preferably about 0.1 to about 5. The concentration of the basic nitrogen-containing polymer in the second solution is about 0.01 to about 10 grams per 100 ml of the organic liquid, more preferably about 0.1 to about 5, and most preferably about 0.1 to about 2. The two solutions of the sulfonated co- or terpolymer and the basic nitrogen-containing polymer are mixed together to form the polymer complex, wherein either the sulfonated polymer or the basic nitrogen-containing polymer such as lauryl methacrylate vinyl pyridine copolymer can be substantially in excess of the other. The formation of the complex is schematically represented by:

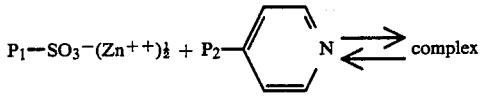

The presence of an excess of one component over the other offers a unique opportunity to alter the viscosity-temperature, viscosity-concentration or viscosity shear rate profiles of such solutions. In the creation of the complex a combination of two polymers interacting with an excess of one (such as the lauryl methacrylate/-vinyl pyridine copolymer), we have created a complex which is, in turn, plasticized. Such a system will display modest viscosity at low or ambient temperatures:

$$\text{Complex} + \overset{\text{Excess}}{\text{Polymer Component}} \rightleftharpoons \text{Plasticized Complex}$$

The application of heat to the right-hand side of Equation 2 would be expected to shift the equilibrium modestly to the left. Consequently, the higher viscosity complex would be favored with a potential increase in solution viscosity.

The weight ratio of the neutralized sulfonated co- or terpolymer to the copolymer of vinyl pyridine with styrene or an alkyl acrylate or an alkyl metharylate is 20/1 to 1/20.

Thus, this concept describes the interaction of two polymers which can give rise to new solution phenomena. A second consequence of this concept is that if such solutions are diluted with non-interactive (less interactive) solvent, such as mineral oil or similar low polarity diluents, the result will be a dimunition of the plasticizer component with a relative increase in complex viscosity. Thus, unlike normal polymer solutions which drop off dramatically upon dilution, these solutions may decrease much less in their solution viscosity. Such hydrocarbon or oil solutions have not been available previously. The concentration of the polymer complex in the organic liquid is about 0.01 to about 20 grams per 100 ml, more preferably about 0.1 to about 10, and most preferably about 0.2 to about 10.

The method of the instant invention includes optionally incorporating a cosolvent, for example, a polar cosolvent, into the mixture of organic liquid and polymer complex, to solubilize the pendant sulfonate groups. The polar cosolvent will have a solubility parameter of at least 10.0, more preferably at least 11.0, and may comprise from 0.1 to 40, preferably 0.5 to 20 weight percent of the total mixture of organic liquid sulfonated polymer, and polar cosolvent.

While this definition of polar cosolvent is adequate, we also observe that cosolvents with especially long alkyl groups with hydroxyl groups on one or both ends are especially preferred. These cosolvents are based on $C_{10}$–$C_{30}$ alkyl chains.

In addition to the requirements for ionic polymer, organic liquid and polar cosolvent, there is the additional and important constraint that the polar cosolvent be more polar than the organic liquid. This is required in order that the proper interaction between polar cosolvent and ionic groups be obtained. If we designate the solubility parameter of the organic liquid as $S_L$, and the solubility parameter of the polar cosolvent as $S_p$, then we require that:

$$S_p \geqq S_L + 1.0$$

In other words, the polar cosolvent will be substantially more polar than the organic liquid to be thickened.

Normally, the polar cosolvent will be a liquid at room temperature, however, this is not a requirement. It is required that the polar cosolvent be soluble or miscible with the organic liquid at the levels employed in this invention. Under normal circumstances, this miscibility requirement precludes the use of water as a polar cosolvent. The polar cosolvent must be present in amounts of from 20 to 600 moles per mole of ionic group in order to give the desirable results of the instant invention and preferably from 30 to 400 moles per mole of ionic group. This level of cosolvent is desirable in creating solutions which can be isoviscous with temperature of concentration.

DESCRIPTION OF THE PREFERRED EMBODIMENTS

The following are preferred embodiments of the instant invention.

EXAMPLE 1

A. Preparation of Terpolymer

A terpolymer of octene-1, ethylene, and ENB was prepared as follows: 2,500 ml of cyclohexane, 500 ml octene-1, 20 ml ENB, and an ethylene feed at a rate of 20 g per hour. The temperature was kept at 25° C. The catalyst containing 5.81 g of $VCl_4$ and 29.3 g of ethylene-sesqui-chloride in a hexane solution was added to the reactor at eight increments of fifteen minutes apart.

The reaction was terminated four hours after the first increment of catalyst addition by precipitation in 3.5 gallons of isopropanol containing a blend of 30 ml concentrated hydrochloric acid and 70 ml of water. The recovered polymer was purified by redissolving in hot cyclohexane and precipitation in a blend of acetone-isopropanol containing 2 g of Irganox 1010 antioxidant. The polymer was then vacuum dried at 70° C., with a final yield of 105 g. The inherent viscosity in decalin at 135° C. was 0.24.

B. Sulfonation of Terpolymer

The polymer of Example 1A was sulfonated using the following procedure: 103 g of polymer was dissolved in 1,169 g of cyclohexane. Sulfonation was affected by the addition of 10.8 ml of acetyl-sulfate at 28° C. After 30 minutes a neutralization agent containing 10.5 g of zinc-acetate in 120 ml of methanol was added. The polymer was then precipitated in methanol and was vacuum dried at 70° C.

The product contained 15.2 milli-equivalents of sulfonate and 0.73 weight percent of zinc.

EXAMPLE 2

Terpolymerization and Sulfonation of Hexene-1, Ethylene and ENB

A. Polymerization

Add to a 5 liter, well-stirred vessel 2,500 ml cyclohexane, 500 ml hexene-1 and 20 ml 5 ethyidene-2 norbornene (ENB), plus an ethylene feed of 20.0 g/hr. Start mixing while purging with nitrogen. Set temperature to 25° C. and add 80 ml DEAC 25 weight percent in hexane) and 24.0 ml $VCl_4$ solution (10 volume percent). Both the $VCl_4$ and the DEAC were injected in eight increments (3.0 ml $VCl_4$ and 10 ml DEAC solution every 15 minutes). After 4 hours the reaction was terminated with isopropylalcohol. Catalyst removal (deashing) was accomplished as follows:

1st step: mixed cement with 2 liter water+50 ml cc HCl+100 Ml Me—OH.

2nd step: mixed cement with 2 liter water+20 ml cc HCl.

3rd step: washed cement with 2.5 liter water. After deashing the cement was poured in 3.5 gallons of acetone.

The precipitated polymer was vacuum dried at 70° C. A polymer yield of 211 grams was obtained. Inherent viscosity of polymer: 3.36 (in decalin at 135° C.).

B. Sulfonation and Neutralization of Terpolymer 210 grams of this polymer was dissolved in 2,500 ml cyclohexane. The terpolymer solution was sulfonated at 35° C. for 1 hour with 20.3 ml acetylsulfate (Ac-.ANH/$H_2SO_4$ molar ratio of 3.0). After 1 hour the "free acid" was neutralized with 22 grams of Zn-acetate +90 ml Me—OH +3 ml water for 2 hours. After neutralization the polymer was steam precipitated and dried in a vacuum oven at 70° C.

The sulfur content of the polymer was 0.50 weight percent of 16.0 meq. The zinc content of the polymer was 1.06 weight percent.

EXAMPLE 3

Copolymerization and Sulfonation of Octene-1 and Ethylidene-Norbornene

A. Polymerization

Add to a 5 liter, well stirred vessel 2,500 ml n-heptane, 600 ml octene-1, and 10 ml 5 ethylidene-2 Norbornene. Start mixing, while purging with nitrogen, and cool it to 20° C. At this point add 50 ml diethylaluminum chloride (25 weight percent in hexane) which contains 8.95 g DEAC and 10.0 ml catalyst slurry. The reaction was carefully controlled at 20° C. for 4 hours and then terminated with 3.5 gallons of MeOH+50 ml 2H NaOH+2.0 grams of stabilizer, Irganox-1010.

After drying the polymer the yield was 130 grams and the inherent decalin viscosity (IV) at 135° C. was 8.5.

B. Sulfonation and Neutralization of Copolymer 30.0 grams of polymer from Example 3A were dissolved in 1,800 ml xylene. The copolymer solution was sulfonated for 60 minutes at 30° C. with 2.1 ml acetylsulfate (AC.ANH/$H_2SO_4$ molar ratio of 3.0). After 60 minutes the "free acid" was neutralized with 2.0 grams of Zn-acetate, 90 ml MeOH and 3.0 ml water. After 2 hours of neutralization (mixing), the sulfonated polymer was precipitated in MeOH and dried in vacuum at 70° C.

The sulfur content of the polymer was about 0.05 weight percent.

The zinc content of the polymer was 0.03 weight percent.

EXAMPLE 4

A. Complex Formation

The sulfonated polymer of Example 1B was dissolved in xylene at a concentration of 1 weight percent (Solution A). A second solution was prepared by dissolving polystyrene-vinylpyridine in xylene at a concentration of 1 weight percent (Solution B). The styrene-vinylpyridine copolymer had a weight average molecular weight of about 2 million and contained about 8 mole percent of 4-vinylpyridine.

The two solutions were mixed at a few ratios to obtain complexes of zinc-sulfo-octene-1 terpolymers with styrene-vinylpyridine.

The viscosity of the various complexes is shown in Table I.

TABLE I

Viscosities of Interpolymer Networks in Xylene at 1 Wt. % and 25° C.

| Composition Solution A/Solution B | Viscosity cP | Shear Rate 1/sec. |
|---|---|---|
| 100/0 | 0.91 | 300 |
| 90/10 | 1,726 | 1.9 |
| 80/20 | 15,340 | 1.3 |
| 50/50 | 1,342 | 22 |
| 0/100 | 6.0 | 300 |

The data in Table I indicate a strong interaction between the polymers in Solutions A and B. The composition of 80/20 that shows the highest viscosity is close to the stoichiometric ratio of functional groups in both polymers.

B. Shear Thickening

The interpolymer complex solutions of Example 4A show a strong dilatant behavior, as indicated in Table II, using the 80/20 composition.

TABLE II

Viscosity-Shear Rate Dependence at 25° C. for an 80/20 Complex at 1 Wt. % in Xylene

| Shear Rate l/sec. | Viscosity cP |
|---|---|
| 0.1 | 670 |
| 0.6 | 4,980 |
| 1.3 | 15,340 |

C. Network Destruction

The addition of a strong cosolvent could destroy the interaction shown in this Example. The 80/20 composition of Example 4B was treated with the addition of methanol. The viscosity dropped from 15,340 cP to 1.65 cP for a solution containing 1 weight percent methanol.

EXAMPLE 5

A. Polymerization

A terpolymer of octene-1, ethylene and ENB was prepared as in Example 1A, except with a higher ethylene feed rate of 30 g per hour.

The polymer yield was 187 g. The inherent viscosity in decalin at 135° C. was 0.45.

B. Sulfonation

The polymer of Example 5A was sulfonated as in Example 1B. The charges were 185 g of polymer, 1,400 hexane (rather than cyclohexane), 13 ml of acetyl-sulfate. Neutralization was conducted with 12.5 g of zinc acetate in 140 ml of methanol.

The product contained 11.2 milli-equivalents of sulfonate per 100 g. and 0.71 weight percent of zinc.

EXAMPLE 6

A. Complex Formation

The sulfonated polymer of Example 5B was dissolved in xylene at 1 weight percent (Solution C). This solution was mixed with Solution B of Example 4A. The data in Table III demonstrate complex formation.

TABLE III

Viscosities of Interpolymer Networks in Xylene at 1 Wt. % and 25° C.

| Composition Solution C/Solution B | Viscosity cP | Shear Rate l/sec. |
|---|---|---|
| 100/0 | 0.96 | 300 |
| 90/10 | 377 | 6 |
| 80/20 | 10,740 | 2.7 |
| 50/50 | 682 | 42 |
| 0/100 | 6.0 | 300 |

B. Shear Thickening

The interpolymer complex solutions of Example 6A show a strong dilatant behavior. The viscosity-shear rate dependence of the 80/20 composition of Example 6A is shown in Table IV.

TABLE IV

Viscosity-Shear Rate Dependence at 25° C. for an 80/20 Complex at 1 Wt. % in Xylene

| Shear Rate l/sec. | Viscosity cP |
|---|---|
| 0.1 | 430 |
| 1.5 | 3,000 |
| 2.7 | 10,740 |

C. Network Destruction

The complex described in Example 6A and 6B was destroyed as in Example 4C by methanol addition. The viscosity dropped from 10,740 cP at 25° C. to 1.67 cP for a solution containing 1 weight percent methanol.

EXAMPLE 7

Formation of a Polymer Complex in Solution

The sulfonated hexene-1 terpolymer of Example 2B was dissolved in xylene at a concentration of 1 weight percent. A second solution was prepared by dissolving a copolymer of styrene and vinylpyridine in xylene at 1 weight percent. The second polymer contained about 8 mole percent of vinylpyridine and had a molecular weight of about 2,000,000 in viscosity average.

The two solutions were mixed at various ratios to obtain interpolymer complexes in solutions of 1 weight percent, as shown in Table V.

TABLE V

Viscosities of Interpolymer Networks in Xylene Solutions at 1 Wt. % and at 25° C.

| Composition Sulfo-Hexene/SVP | Viscosity, cP | Shear Rate, sec.[1] |
|---|---|---|
| 100/0 | 1.32 | 300 |
| 97.5/2.5 | 2.09 | 300 |
| 95/5 | 20.1 | 30 |
| 90/10 | 2,900 | 4 |
| 75/25 | 1,045 | 17 |
| 50/50 | 35.8 | 124 |
| 0/100 | 6.0 | 300 |

From the data in Table V it can be seen that a strong network was developed at a ratio of about 90/10 due to the very high viscosity obtained relative to the low viscosities of the individual components.

What is claimed is:

1. A method for controlling the viscosity of organic liquids, said organic liquid having a solubility parameter of from about 6 to about 10.5, which comprises incorporating in said organic liquid a minor amount of a polymer complex, said complex being comprised of a sulfonated terpolymer of hexene-1/ethylene/ENB or a sulfonated terpolymer of octene-1/ethylene/ENB or a sulfonated copolymer of octene-1/ENB or a sulfonated copolymer of hexene-1/ENB, wherein said copolymer or said terpolymer contains about 1 to about 40 meq. of metal neutralized sulfonate groups per 100 grams of said copolymer or said terpolymer, said metal neutralized sulfonate groups contain a metal ion selected from the group consisting of Group IA, IIA, zinc, antimony, lead, copper, iron, nickel and cobalt of the Periodic Table of Elements and polymer B, containing basic nitrogen groups, said basic nitrogen groups being present at a level of from about 8 to 200 meq. per 100 g. of polymer B, wherein polymer B has the formula:

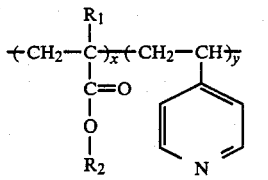

or

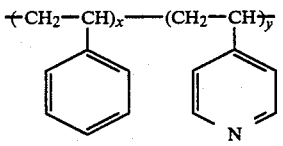

wherein $R_1$ is H or an alkyl group having about 1 to about 8 carbon atoms, $R_2$ is an alkyl group having about 1 to about 18 carbon atoms, x is about 50.0 to 99.8 mole percent and y is about 0.2 to about 50.0 mole percent wherein the weight ratio of said sulfonated co or terpolymer to polymer B is about 20/1 to about 1/20.

2. The method of claim 1, further including a polar cosolvent, wherein said polar cosolvent comprises from about 0.1 to 40 weight percent of the total mixture of organic liquid, polymer complex and polar cosolvent.

3. The method of claim 1 or 2 wherein said polymer complex has from about 0.1 to about 10 mole percent pendant sulfonate groups.

4. The method of claims 1 or 2, wherein polymer B is a copolymer of lauryl methacrylate and vinyl pyridine.

5. The method of claim 1, wherein said sulfonate groups are neutralized with basic compounds selected from groups of transition elements.

6. The method of claims 1 or 2, wherein said polymer complex is incorporated into said organic liquid at a level of from 0.01 to 20 grams/100 ml.

7. The method of claims 1 or 2, wherein said organic liquid has a viscosity at 100° F. of less than 100 centipoises.

8. The method of claims 1 or 2, wherein said organic liquid is a lubricating oil.

9. The method of claims 1 or 2, wherein said sulfonated co- or terpolymer is in excess of said basic nitrogen-containing polymer.

10. The method of claims 1 or 2, wherein said basic nitrogen-containing polymer is in excess of said sulfonated polymer.

11. The method of claim 2, wherein said polar cosolvent is selected from the group consisting of alcohols and amines.

12. The method of claim 2, wherein said polar cosolvent has a boiling point of at least 50° C.

13. A composition of matter which is a polymer complex which is the reaction product of a sulfonated co- or terpolymer and a basic nitrogen-containing polymer, said basic nitrogen containing polymer having the formula:

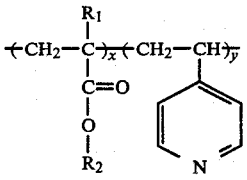

or

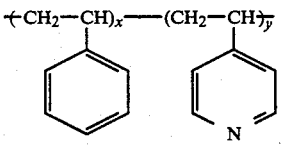

wherein $R_1$ is H or an alkyl group having about 1 to about 8 carbon atoms, $R_2$ is an alkyl group having about 1 to about 18 carbon atoms, x is about 50.0 to 99.8 mole percent and y is about 0.2 to about 50.0 mole percent, wherein said sulfonated co- or terpolymer is selected from the group consisting of a sulfonated terpolymer of hexene-1/ethylene/ENB, a sulfonated terpolymer of octene-1/ethylene/ENB, a copolymer of hexene-1/ENB and a copolymer of octene-1/ENB, wherein said sulfonated co- or terpolymer has about 1 to about 40 meq. of metal neutralized sulfonate groups per 100 grams of said sulfonated co-or terpolymer, said sulfonated groups being affixed to said ENB, said metal neutralized sulfonate groups containing a metal ion selected from the group consisting of Groups IA, IIA, zinc, antimony, lead, copper, iron, nickel and cobalt of the Periodic Table of Elements, said basic nitrogen-containing polymer containing about 8 to about 200 meq. of basic nitrogen groups per 100 grams of said basic nitrogen-containing polymer, the weight ratio of said sulfonated co- or terpolymer to said basic nitrogen-containing polymer being about 20/1 to 1/20.

14. The composition of claim 13, wherein said basic nitrogen-containing polymer is a lauryl methacrylate/-vinyl pyridine copolymer.

15. The composition of claim 13, wherein said sulfonated polymer is of hexene-1/ethylene/ENB or a sulfonated polymer of octene-1/ethylene/ENB.

16. The composition of claim 13, wherein said sulfonated co- or terpolymer is in excess of said basic nitrogen containing polymer.

17. The composition of claim 13, wherein said basic nitrogen containing copolymer is in excess of said sulfonated co- or terpolymer.

18. The composition of claim 13, wherein said sulfonate groups are neutralized with basic compounds selected from Groups IIA, IB, and IIB of the Periodic Table of Elements, and basic lead, tin and antimony compounds.

* * * * *